United States Patent [19]

Scuka

[11] Patent Number: 5,070,319

[45] Date of Patent: Dec. 3, 1991

[54] DOOR AJAR ALARM FOR REFRIGERATION UNIT

[75] Inventor: Rodney W. Scuka, Carrollton, Tex.

[73] Assignee: Ranco Incorporated of Delaware, Wilmington, Del.

[21] Appl. No.: 542,514

[22] Filed: Jun. 22, 1990

[51] Int. Cl.[5] ..... G08B 21/00; G08B 3/00

[52] U.S. Cl. ..... 340/384 E; 310/323; 340/547; 340/691

[58] Field of Search ..... 340/384 E, 691, 547; 310/323, 322, 321, 324

[56] References Cited

U.S. PATENT DOCUMENTS

| | | | |
|---|---|---|---|
| 700,812 | 5/1902 | Peyton | 335/205 |
| 2,386,279 | 10/1945 | Tibbetts | 310/328 |
| 2,924,682 | 2/1960 | Winterburn | 335/158 |
| 2,957,320 | 10/1960 | Armentrout | 62/264 |
| 3,161,742 | 12/1964 | Bagno | 335/208 |
| 3,305,805 | 2/1967 | Tann | 335/153 |
| 3,426,166 | 2/1969 | Canceill | 200/61.62 |
| 3,470,554 | 9/1969 | Corbell | 340/513 |
| 3,596,021 | 7/1971 | Saul | 200/61.93 |
| 3,707,131 | 12/1972 | Massa | 310/324 |
| 3,710,369 | 1/1973 | Takahashi | 340/547 |
| 3,761,956 | 9/1973 | Takahashi et al. | 310/324 |
| 3,772,669 | 11/1973 | Johnston et al. | 328/59 |
| 3,896,404 | 7/1975 | Peterson | 335/205 |
| 3,943,485 | 3/1976 | Waldman | 340/517 |
| 3,986,183 | 10/1976 | Fujiwara | 340/572 |
| 4,160,972 | 7/1979 | La Mell et al. | 340/541 |
| 4,216,402 | 8/1980 | Engdahl | 310/320 |
| 4,241,337 | 12/1980 | Prada | 340/547 |
| 4,374,377 | 2/1983 | Saito et al. | 340/384 E |
| 4,438,430 | 3/1984 | Young et al. | 340/547 |
| 4,691,195 | 9/1987 | Sigelman et al. | 340/545 |
| 4,691,363 | 9/1987 | Khanna | 381/205 |
| 4,707,684 | 11/1987 | Janke et al. | 340/530 |
| 4,891,626 | 1/1990 | Neuman | 340/547 |

*Primary Examiner*—Glen R. Swann, III

*Attorney, Agent, or Firm*—Watts, Hoffmann, Fisher & Heinke Co.

[57] ABSTRACT

An alarm system for signalling when a door of a refrigeration unit compartment is not fully closed comprises an alarm condition sensing system having a door sealing gasket magnet and a magnetically actuated switch. The gasket magnet produces an elongated narrow magnetic field for coupling the unit and the door in sealing relationship when the door is fully closed. The switch senses the magnetic field when the door is closed even though the magnet position may be anywhere in a band of possible positions. An alarm system signals when a door of a refrigeration unit compartment is not fully closed. The alarm assembly comprises a housing wall section, a vibratable alarm member, and mounting structure for connecting the alarm member to the housing wall section so that the housing wall section is driven by the member and vibrates relative to the housing when the member vibrates at an operating frequency. A plainly audible alarm is produced when a door ajar condition is sensed.

7 Claims, 8 Drawing Sheets

DOOR AJAR ALARM FOR REFRIGERATION UNIT

BACKGROUND OF THE INVENTION

1. Field of the Invention.

The present invention relates to refrigerator and/or freezer units for perishables and more particularly to such units having an alarm system for preventing loss of perishables by signalling when an access door is not closed.

2. Description of the Related Art.

Perishable materials of various sorts are kept in refrigerator and/or freezer units in order to maximize shelf life. An example is the household refrigerator freezer unit in which substantial amounts of refrigerated foodstuffs may be kept in separate compartments. If the access door of an unattended refrigerator-freezer unit is not fully closed, the open compartment can become sufficiently warm that the contents are damaged by defrosting, spoilage or both. If the access door remains open long enough without being discovered the unit itself can be damaged, usually as a result of wear and tear on the refrigerant compressor.

The same problems are encountered in freezers and single door refrigerators. For convenience, all these units are identified collectively as "refrigeration units."

It has been recognized that door ajar problems can be minimized by drawing attention to the unclosed access door before any harm occurs. Alarms for signalling when an access door is not fully closed have been proposed An alarm capable of effectively signalling an open door condition can be annoying to a user who keeps the door open during loading the refrigeration units, cleaning or defrosting Alarm systems have thus been proposed for signalling a door open condition without producing an alarm when the user intends leaving the door open for an extended period. U.S. Pat. No. 3,996,434 discloses one such approach.

Other prior art proposals have been constructed to sense when an access door is open and produce an alarm after a predetermined time. These avoided undesired alarms when the unit was being loaded or unloaded, yet produced a warning when an access door was open overlong.

So called "after market" alarms, constructed and arranged for attachment to an existing unit by a serviceman or its owner, have also been proposed. These alarms were principally interesting to those who suffered losses from an open access door and were willing to spend money to avoid a recurrence. Such alarm units were designed and constructed for "universal" application to many different kinds and types of units. These alarms were expensive, because relatively few were produced, unattractive when installed and not particularly effective when used with certain units. An example of an after market type of alarm is disclosed in U.S. Pat. No. 4,691,195.

Alarms proposed for assembly in refrigeration units by the original equipment manufacturer (OEM) had the advantage of being "built in" and therefore not unattractive. These alarms, because constructed and arranged specially for particular units, tended to operate more reliably with their units than did after market alarms placed on the same units. 0.E.M. installed alarms were complex (and thus expensive), so that their inclusion in production refrigeration units added materially to the retail selling price. Worse, they were not always reliable. Alarms which failed to detect open access doors were just as unacceptable as alarms which falsely signalled an open door condition. In the latter case a service call would be required to correct the problem.

Some prior art proposals utilized access door position sensors formed by electric switches for controlling piezo electric alarm devices. U.S. Pat. No. 4,707,684 discloses a door ajar sensor arrangement having a door actuated control switch coupled to a piezo electric sound transducer through a timer. When the door closed a switch plunger was depressed and the alarm disabled. When the door opened, the plunger was positioned to operate the timer. When the timer timed out, the transducer was energized and sounded the alarm.

This seemingly straight forward approach has not been favored because plunger type switches, in the environment of a refrigeration unit door ajar sensor, are not reliable over the typical life of such a unit. The switches must be positioned remote from the door hinges in order to assure sensitivity to a door ajar condition. When placed at such locations the plungers are apt to become fouled as a result of food spills and jammed in the depressed position. When struck by objects as the unit was being loaded or unloaded, the plungers were sometimes deformed and jammed in their depressed positions. When a plunger jammed in the depressed position the alarm was disabled.

This failure mode was not "fail-safe" because access doors could remain ajar without any alarm being produced. Furthermore, there was little likelihood the switch failure would be noticed before a loss was experienced.

Magnetically operated sensors have been proposed to avoid such problems. These sensors can be constructed as sealed units disposed within the cabinet walls or an access door and thus not subject to failure as a result of impacts or food spills. One proposal of this general type is disclosed by U.S. Pat. No. 4,241,337 wherein access doors of a side-by-side refrigerator-freezer are provided with a magnet and a sensor unit, respectively.

In this proposal the sensor was formed by Hall effect switches in one access door. Fully closing both access doors precisely aligned the sensor with a magnet carried by the other access door. The Hall effect switches changed conductive states when the doors fully closed so that no door ajar alarm sounded. If the doors are not fully closed for a predetermined time an alarm sounded.

These kinds of alarms had relatively many parts and required special construction of the refrigerator-freezer units containing them. Furthermore the doors on such units tended to droop after a period of use which led to magnet and sensor misalignment. Misalignments created false door ajar alarms and led to otherwise unnecessary service calls. Still further, the door magnets are so weak that amplification of the Hall effect sensor outputs is often required in order to produce a usable signal.

Refrigerator and freezer doors commonly carry peripheral sealing gaskets containing "latching" magnets for securing the door closed. The gaskets are rubber-like and tubular. The magnets are long flexible strips placed inside the gaskets. When a door is closed the magnet is coupled to the magnetic cabinet material extending about the access opening.

The magnets typically extend throughout the length of the gasket and are intentionally made to be "weak."

This minimizes the force required to open the door and is an important safety feature. In the past these magnets have been used to operate magnetically sensitive elements to govern a function associated with the refrigerator. An example is disclosed by U.S. Pat. No. 2,957,320 where the gasket magnet is used to operate a compartment light.

Use of door gasket magnets in door ajar alarms would seem an attractive idea because the alarm cost might be reduced significantly. There were some serious practical drawbacks. Door gasket magnets were not precisely located from unit to unit. First, the gasket locations on the doors ranged within relatively wide tolerance bands. Thus the magnet locations were not tightly controlled. Second, since access doors sag over time, as noted above, the gasket and magnet positions relative to the refrigeration unit were not predictable during use. This combination of factors made accurate detection of door position difficult.

Aggravating the situation is the fact that the door gasket magnets produce weak, peculiarly shaped magnetic fields. The magnets are typically elongated strips constructed with a central longitudinally extending south pole and north poles extending along the opposite lateral sides of the strips. The fields produced by such magnets are quite narrow.

Accurately determining door position for door ajar alarm purposes is thus a difficult matter compared to merely sensing whether a compartment light might be turned off. In the former case the alarm system must be capable of accurately discriminating between an indicated door ajar condition and a door closed condition indicated by a narrow, weak magnetic field produced by a magnet having a position which can vary relatively widely from unit to unit.

U.S. Pat. No. 4,891,626 proposes constructing a door ajar alarm system employing multiple magnetic field responsive switches for detecting a single magnetic door gasket. The switches are mounted in the compartment wall surrounding the access opening. They are offset from each other relative to the nominal magnet location so magnet position variations from unit to unit do not prevent the alarm from operating properly The switches are connected in parallel with each other so actuation of any one of them serves to enable the alarm system.

The '626 patent proposes reed switches or hall effect switches mounted along a line extending at an angle through the narrow elongated magnetic field produced by the door gasket magnet. The respective switch axes are oriented parallel to each other while the switches are offset laterally relative to the magnetic field location. This arrangement of two or more switches is employed to assure that the alarm system is responds regardless of gasket magnet location variations. The use of plural duplicate switches is costly and unduly complicates the alarm system construction. The multiplicity of parts and circuits also tends toward less reliable operation.

The magnetically responsive switches are connected to a remote alarm circuit mounted in the appliance so that when the door is not fully closed the alarm is tripped by one or more of the switches The alarm system employs a commercially constructed buzzer device and circuit for operating the buzzer. Alternative alarm systems used commercially available piezoelectric alarm devices with operating circuits as noted previously.

These kinds of alarm devices were usually mounted in a separate housing attached to the refrigeration unit. They were expensive because they employed purchased, or separately constructed, components and subassemblies which had to be assembled into a housing and mounted to the appliance.

The alarm housings were generally placed on the exterior of the appliance to maximize their loudness. The environment in which the unit was placed was often such that the alarm units could be fouled by dust, dirt and airborne cooking oil elements common in kitchens. In some instances the units were exposed to extremes of heat and cold, for example when used with a freezer located in an unheated basement or porch.

The present invention provides a new and improved door ajar alarm system for a refrigeration unit providing for simplified, highly effective alarm device.

SUMMARY OF THE INVENTION

In accordance with a preferred embodiment of the invention an alarm system for signalling when a door of a refrigeration unit compartment is not fully closed comprises an alarm condition sensing system and an alarm signalling device rendered effective when the door is not properly closed. The signalling device comprises a housing, an alarm assembly, and an alarm assembly driving circuit connected between the sensing switch and the alarm assembly. The housing is connected to the refrigeration unit and supports the alarm assembly and the circuit.

The alarm assembly comprises a housing wall section joined to the housing by bridge structure which is flexible for enabling the housing wall section to move relative to the housing, a vibratable alarm member, and mounting structure for connecting the alarm member to the housing wall section so that the housing wall section is driven by the member and vibrates relative to the housing when the member vibrates at an operating frequency. A plainly audible alarm is produced when a door ajar condition is sensed.

The alarm member driving circuitry drives the alarm member at the operating frequency when the door is not fully closed for a predetermined time.

BEST KNOWN MODE OF PRACTICING THE INVENTION

Figure 1:
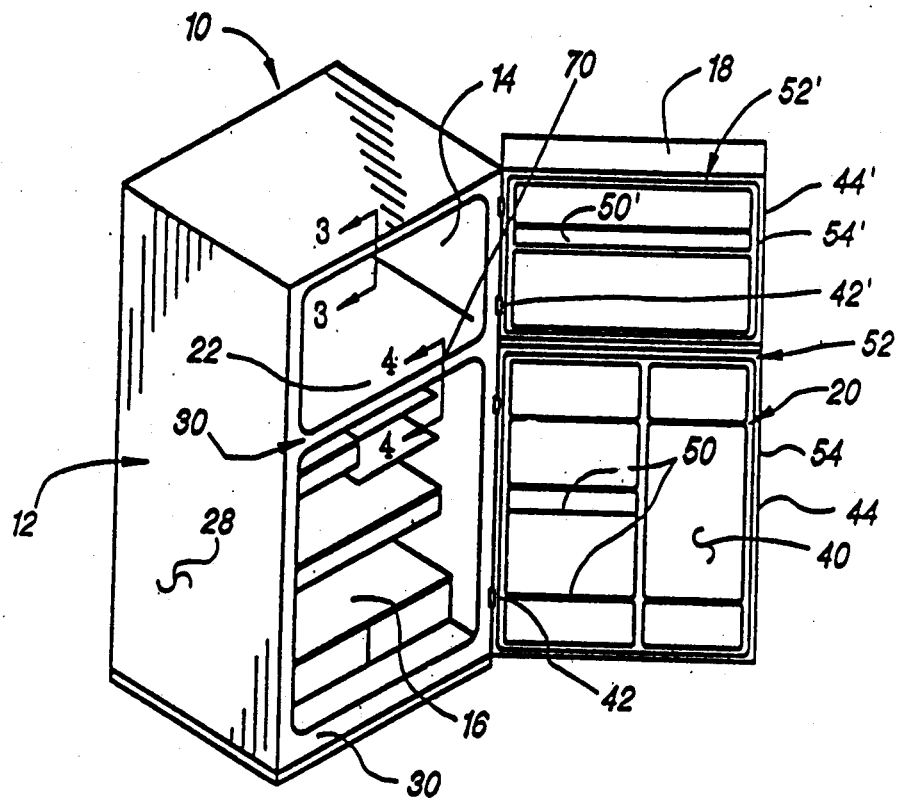
FIG. 1 is a schematic perspective view of a refrigerator-freezer unit equipped with a door ajar alarm system embodying the present invention.

A refrigeration unit 10 constructed according to the present invention is illustrated by FIG. 1 of he drawings. The unit 10 is illustrated as a refrigerator-freezer having an insulated cabinet 12 defining a freezer compartment 14, a refrigerator compartment 16, respective access doors 18, 20 for the compartments, and a door ajar alarm system 22 for signalling when either door has not been properly closed for a predetermined time.

In the illustrated unit 10 the door ajar alarm system produces a series of audible alarm tones when either access door has not fully closed for a period of three minutes. In the illustrated unit the alarm tones have a duration of about seven tenths of one second each and occur at intervals of bout one second. The tone is relatively loud and has a frequency of about 2000 hertz.

Figure 2:
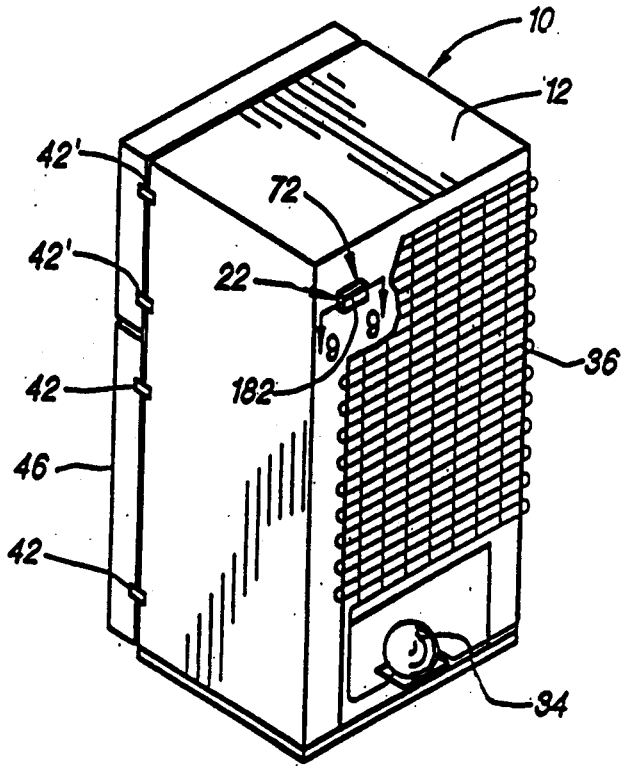
FIG. 2 is a view of the unit of FIG. 1 from a different perspective.

The cabinet 12 is constructed from steel structural elements including a sheet steel skin 28 defining a cabinet wall section 30 (sometimes called a mullion) surrounding the compartment access openings. The cabinet 12 supports the refrigerant compressor 34, the refrigerant condenser heat exchanger 36 (FIG. 2) and other associated refrigeration system components (not illustrated). Thermal insulating material is disposed about and between the refrigerated compartments within the cabinet skin 28.

The access doors 18, 20 are of conventional construction. The door 20 is described briefly and components of the door 18 which are structurally and functionally similar to components o the door 20 are illustrated by corresponding primed reference characters. The door 20 is formed by a door body assembly 40, hinges 42 attaching the door body of the cabinet, and a latching and seal assembly 34 for maintaining the door fully closed and sealed about its compartment.

The door body assembly comprises a structural framework (not shown) carrying an outer skin 46 of sheet metal or other suitable material, a handle (not illustrated), integral shelving structure 50 on the 'inside' of the door, and insulating material (not shown) within the door body between h shelfing structure and the outer skin. The shelving structure defines a peripheral extending face 52 confronting the mullion 30 when the door 20 is closed.

The door latch and seal assembly 44 coacts between the mullion 30 and the door face 52 to maintain the door 20 closed and to sail the compartment 16 against the entry of atmospheric air. The assembly 44 is fixed to the door face 52 has is conventional. The means of connection may be any suitable, conventional construction and is not illustrated. The assembly 4 comprises an elongated resilient door gasket 54 and a gasket magnet 56 supported by and coextending with the gasket (see FIG. 3).

The gasket 54 is of conventional construction in that is is formed by a supple, softly resilient body 60 attached the door face 52 and extending toward engagement with the mullion 30. The body is formed from a rubber-like material defining an flat mullion engaging seal face 57 and convoluted sidewalls 58 disposed about a hollow central core 64. The gasket is illustrated as formed by moled strips, but may e fabricated by other methods.

The gasket magnet 56 is a thin, flat relatively narrow elongate strip of magnetic material extending within the core 64 along the inside of the sail face 57. The magnet denies a south pole region S extending along the magnet center line and coding about the central third of the magnet width. North pole regions N extend along the a opposite magnet side edges parallel to the south pole (see FIG. 3). The magnet produces a relatively narrow, elongated magnetic field F extending outwardly from the magnet beyond the seal face. The magnetic field is double lobed because f of the pole configuration. The field lobes extend parallel to each other, spaced slightly apart, with the field strength between the lobes adjacent the south pole being minimized.

The magnet 56 is positioned sufficiently close to the seal face 57 so that when the door 20 is closed the magnetic force attracts the door to the mullion 30. The gasket gseal face 57 is urged into sealing engagement with the mullion 30 by the magnet and the gasket convolutions flex to enable the face move slightly into engagement with the mullion.

This action increases the flux coupling between the magnet and the mullion and insures a maximized force for closing the door on the cabinet. As a result, the magnetic flux in the mullion 30, and the attracted force, are markedly greater when the door is fully closed than when the door is slightly ajar. The magnetic thus creates a latching effect when h door is fully closed.

The magnet 56 is selected to be sufficiently weak that the total force resisting door opening is insufficient to prevent the door being pushed open from within its compartment.

Figure 3:
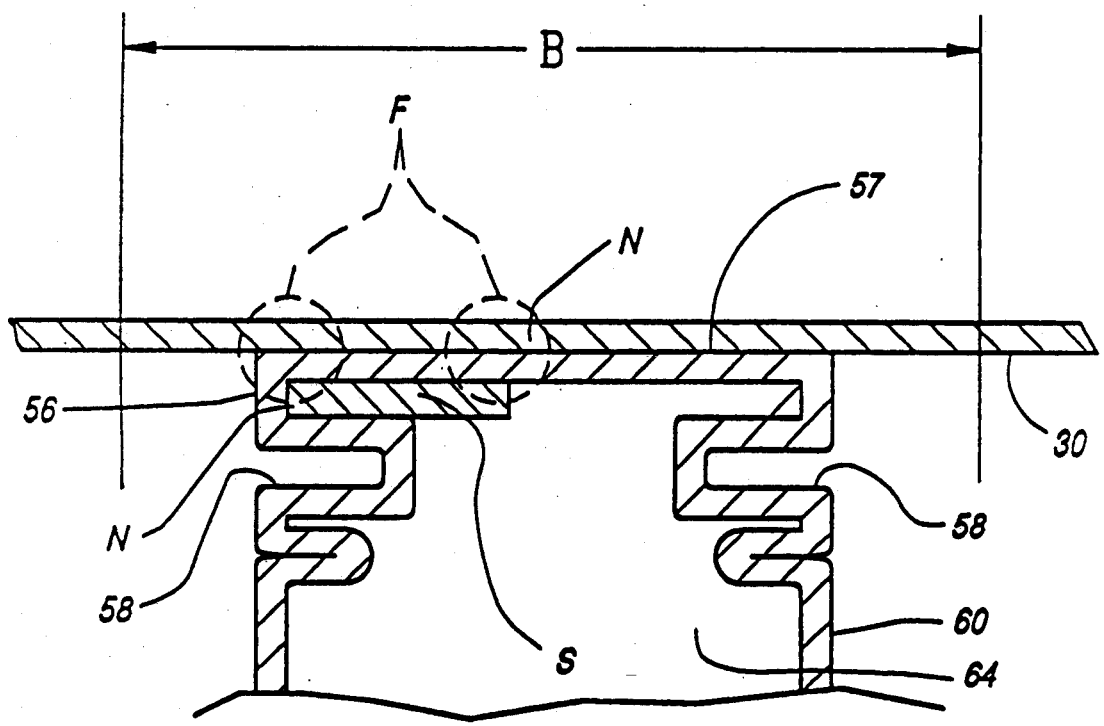
FIG. 3 is an enlarged fragmentary cross sectional view seen approximately from the plane indicted by the line 3—3 in FIG. 1 with parts shown in alternate positions.

The gasket may be attached to the face by hand and fixed in place within a fairly wide tolerance range. The mullion 30 and the door face 52 are relatively wide so the location of the gasket on the door is not particularly critical. In use, the doors tend to sag on their hinges somewhat over time due to loading the door shelves structure. As a result thee is a permissible wide range of locations where the magnetic field F may be coupled to the mullion 30 at the center of the mullion. The magnetic field may align with the mullion center anywhere in a band of locations varying within plus or minus ¼ inch vertically from a nominal location, i.e. anywhere within a band f possible field locations which is appreciably wider than the magnet itself. This band is illustrated in FIG. 3 and indicated by the letter B.

The alarm system 22 is constructed and arranged to produce an alarm when an access door has remained away from its fully closed position more than a predetermined time. The alarm system 22 comprises an alarm condition sensor 70 (FIGS. 1, 4 and 5) for detecting whether the door is fully closed and an alarm signalling unit 72 (FIGS. 2, 8 and 9) for producing an alarm to alert the user of the unit 10 to the open door condition.

Figure 4:
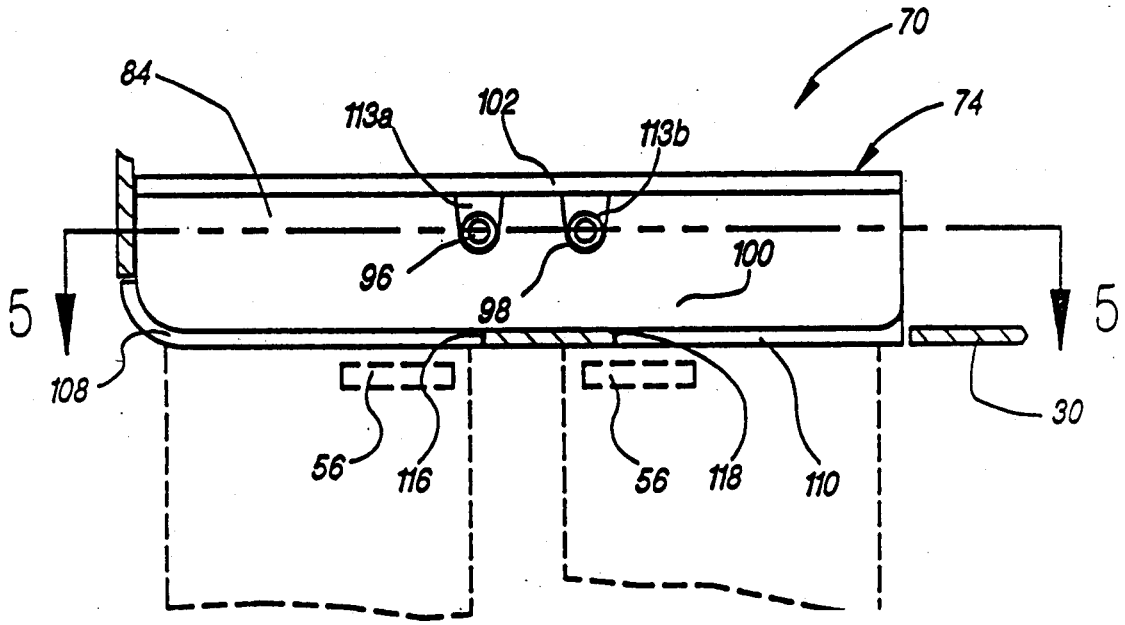
FIG. 4 is an enlarged fragmentary cross sectional view seen approximately from the pane indicated by the line 4—4 in FIG. 1 with parts shown in alternate positions.
Figure 5:
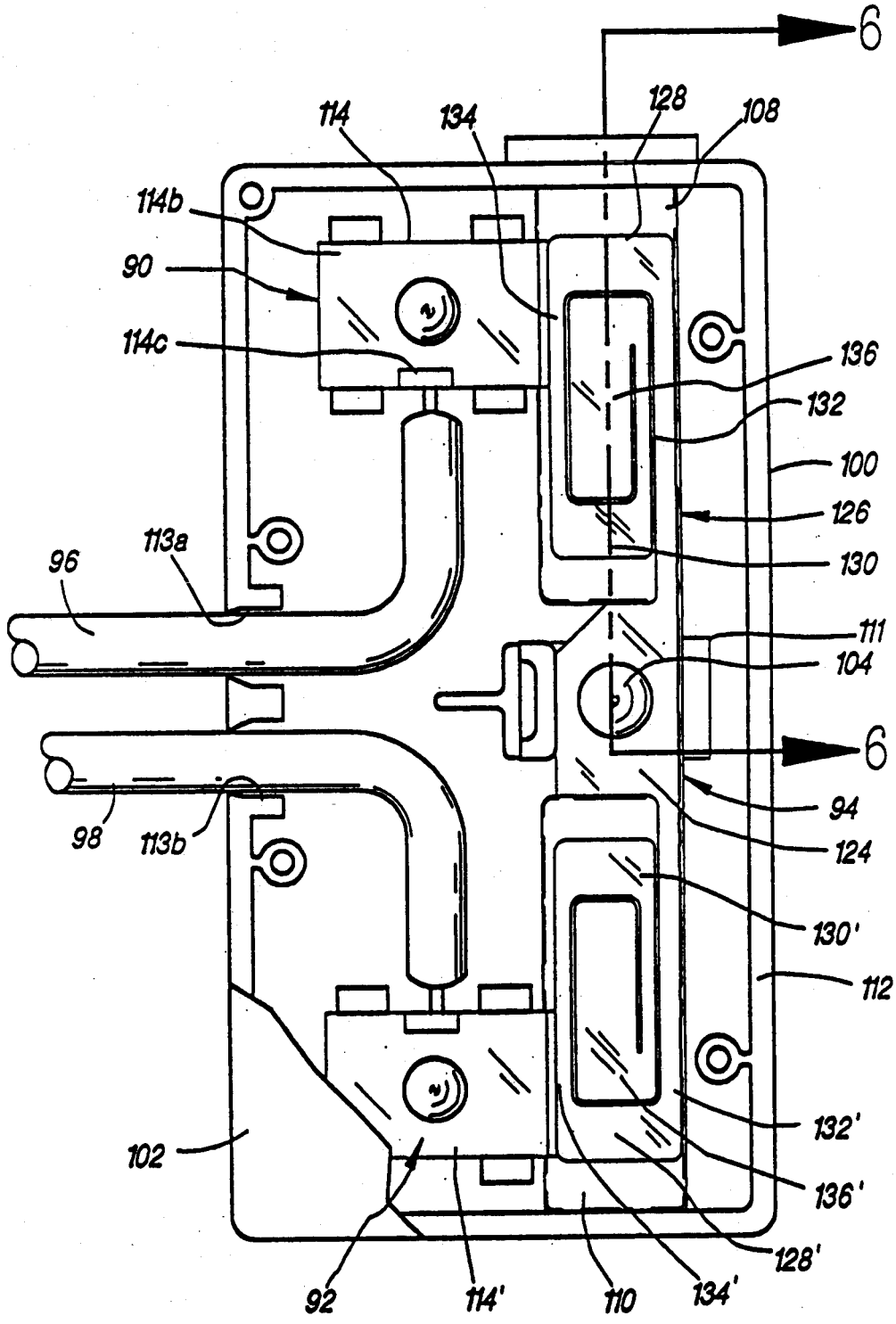
FIG. 5 is a cross sectional view seen approximately from the plane indicated by the line 5—5 of FIG. 4.

The alarm condition sensor 70 comprises a magnetic field producing structure and a magnetic field responsive position detector 74 for determining whether the door is fully closed (FIGS. 4 and 5). An important feature of the alarm condition sensor is that the magnetic field producing structure can e, an d in the illustrated embodiment is, formed by the gasket magnet 56. Thus, in the illustrated embodiment, the door magnet not only latches the door shut but also signals the door closure status condition of the position detector 74.

The magnetic field responsive position detector 74 is formed by a magnetically responsive electrical switch unit actuatable by a door gasket magnetic field for controlling the alarm signalling unit 72. The illustrated switch unit comprises a housing 84 mounted in the mullion 3 between the compartments 14, 156, stationary contact assemblies 90, 92 (FIG. 5) supported by the housing and a movable contact arrangement 94 for completing an interrupting a circuit between the stationary concept assemblies in response to the sensed presence and absence, respectively, of effective magnetic fields. The switch unit contacts are connected to the alarm signalling unit by lead wires 96, 98 coupled to the stationary contact assemblies.

The housing 84 is mounted in the cabinet behind the face of the mullion 30 between hecompartments 14, 16. The housing is mounted at the center of the mullion 30 is nominal alignment with the magnetic fields F of the gsket magnets on the door 18, 20 when the doors are fully closed. The preferred housing 84 comprises a rectangular cup-like case 100, a cover 102 secured over the open side of the case, a support pedestal 104 for the movable contact, the stationary contact supporting lug-like embossments 108,110 adjacent the pedestal. The housing 84 is centered in the mullion between the cabinets sides so that the door 18, 20 may b hinged to the cabinet at either side without affecting the switch alignment.

The case 100 is a molded plastic pat (preferably polypropylene) having a base 111 and a skirt-like sidewall 112 extending from the base to the open case side. A pair of lead wire pots **113*a*, 113*b* is formed in the sidewall 112 to accommodate the lead wires 96, 908. After the switch unit parts have been assembled in the case 100, the cover 102**, which is molded polypropylene, is ultrasonicaly welded to it and the housing is mounted inside the mullion of arcade. The illustrated housing is segued to the mullion but other means can be employed to achieve the connection.

The mullion 30 is provided with cutouts 116, 118 (FIG. 4) which conform to and receive the lug-like base projection 108, 110. The projections extend through the mullion wall cutouts with their outer surfaces disposed flush with the mullion surface. The gasket on each door is aligned with a respective base projection. The case material is not a magnetic flux conductor and therefore the magnetic fields extend through base projections to the movable contact arrangement 94. In the preferred system 22 an adhesive baked paper label, or thelike, is adhered to the mullion 30 covering the projections 108, 110 to protect them from tampering.

Figure 6:
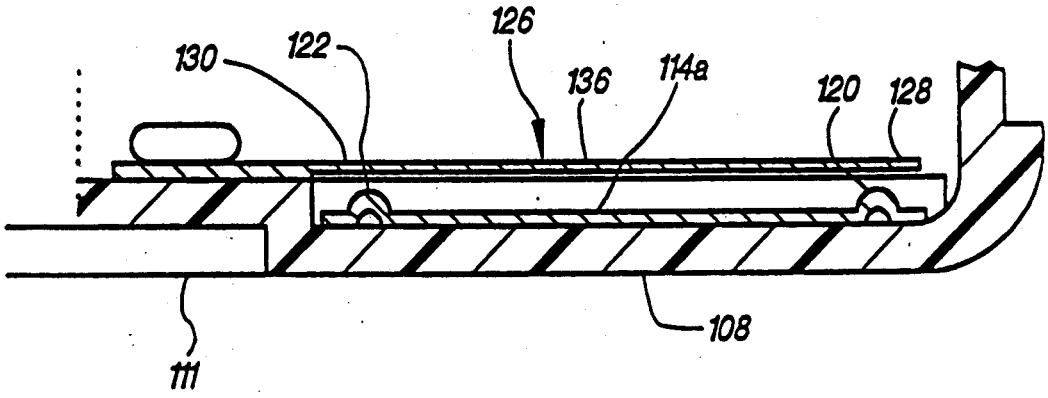
FIG. 6 is an enlarged fragmentary cross sectional view seen approximately from the plane indicted by the line 6—6 of FIG. 5.

The stationary contact assembles 90,92 are substantially alike and only one, the assembly indicated by the reference character 90, is described in detail. Corresponding parts of the contact assembly 92 are indicated by indical primed reference characters. The assembly 90 includes a contact plate 114 having a plate section **114*a* (FIGS. 6–6) seated int e recessed area of the embossment 108, a plate section 114*b* fixed to the base, and a lead wire connecting tab 114*c* projecting from the section 114*b*** to which the lead wire is soldered.

In the preferred and illustrated embodiment the plate 114 is stamped to produce a step between the plate sections **114*a*, 114*b*. The sampling operation also forms spaced apart embossed contractors 120, 122 (FIGS. 6–8) projecting from the section 114*a* in the direction of the cover 102. The contractors 120, 122** are spaced apart in a direction transverse to the direction of extend of the magnetic field F when the door is fully closed. In the illustrated embodiment the contractors are disposed at right angles to the direction of extent of the magnetic field.

A mounting hole is stamped in the plate section **114*b* for receiving a cylindrical mounting lug mold into the base. The end of the lug projecting through the hole is ultrasonicaly heated and upset to fix the plate 114** in the housing.

The movable contact assembly 94 is constructed and arranged to electrically engage one of the contacts 120, 122 whenever the door 20 is fully closed regardless of the location of the magnetic field F within the band B FIG. 3). The assembly 94 comprises a support body 124 and an elongated magnetic contact pad structure 126 movably supported by the body 124. The pad structure comprises first and second contacts 128, 130 spaced apart transverse to the direction of h extent of the magnetic field and first and second springs 132, 134, resiliently supporting the respective contacts 128, 130 for independent motion relative to each other under the influence of the magnetic field. Each contact 128, 130 is aligned with and positioned for engagement with a respective one of the contractors 120, 122.

The illustrated movable contact assembly also comprises a second elongaed magnetic contact pad structure 126' having contacts 128', 130' supported by springs 132', 134', respectively. The regions 128', 130' are aligned with selective fixed contractors (not shown but like the contractors 120, 122). One, or the other, or both of these contractors are elongaed when the door 18 is fully closed. The movable contact pad structures 126, 126' and associated parts are the same in all respects and differ only in that each coasts with a different compartment access door. For this reason only the pad structure 126 and its associated elements are described in detail.

The contact pad structures and their associated stationary contacts are connected in series across the lead wires 96, 98 so that the circuit through the sensor switch unit is completed only when the doors 18, 20 are fully closed and interrupted only upon opening one or both doors.

The contact assembly 94 is preferably formed from a single leaf-like blade or resilient, magnetically responsive metal, preferably cold rolled steel shim stock characterized by having a very low coercive force (minimum residual magnetism). The blade is 0.002 inches thick and has an elongated gneraly rectangularly shape. A mounting hole in the body 124 receives the pedestal 140 after which the projecting pedestal end is ultrasonicaly heated and upset to clamp the body in place. The pad structure 126 extends cantilever fashion from the body 124 in close proximity to the associated stationary contractors 120, 122.

The illustrated blade is stamped or eteched to form the pad structures and body. The contracts and springs are thus formed from a continuous piece of material. The contacts 128, 128', 130, 130' are preferably formed by plating or otherwise depositing a coating of highly conductive material, like gold, along bands (corresponding to the contacts) on the pad structures for engagement with a respective one of the contractors 120, 122. These coatings assure efficient low voltage signal transmitting junctions between the pad structures and each contractor when they touch.

It should be further noted that although the unit 10 is disclosed as a combination freezer-refrigerator, having two access doors it could be a freezer or a refrigerator having a single access door. Such a unit would require only one gasket magnetic and one associated contact pad structure, with its related elements, to effectively operate the door ajar alarm system.

The pad structure 126 is so constructed and arranged that the spring 132 projects from body 124 and effectively supports the remote end of the pad structure 126 and its contact 128 cantilever fashion. When the door 20 is fully closed and the magnetic field F is located remote from ehbody 124, the spring 132 resiliently deflects to move the contact 128 into engagement with the contractor 120.

Figure 7:
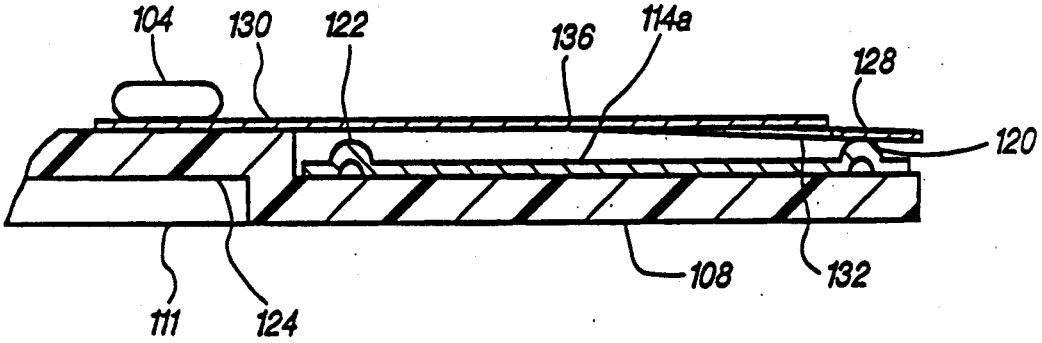
FIGS. 7 and 8 are views similar to FIG. 6 with parts shown in alternate operating positions.

This condition is illustrated in FIG. 7. In this "worst case" scenario the magnetic attractive once exceeds the force of the spring 132 as it opposes pad structure movement. The spring deflects to engage the contact 128 with the contractor 20. The contact 130 remains spaced from the contractor 122 because the applied magnetic force adjacent the contact 130 is quite small.

The second spring 134 projects from the end of the spring 132 and the contact 128 back toward the body 124. The projecting end of thespring 134 resiliently supports the end of the pad structure advice the body and its contact 130 cantilever a fashion. When eh door 20 is fully closed and the magnetic field F is located close to the body 124, the spring 134 resiliently deflects to move the contact 130 into engagement with theconactor 122.

Figure 8:
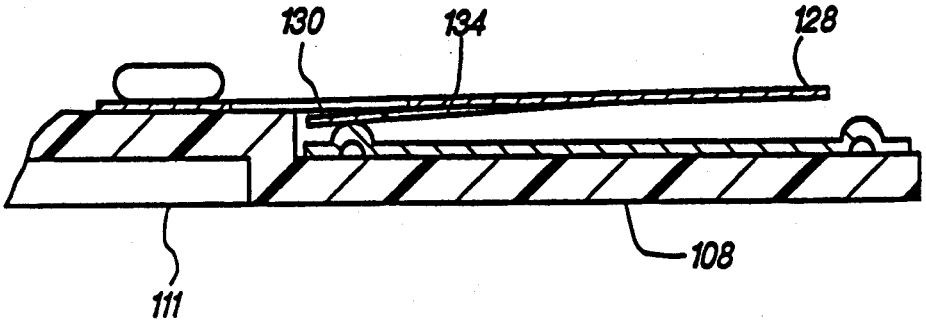
Figure 9:
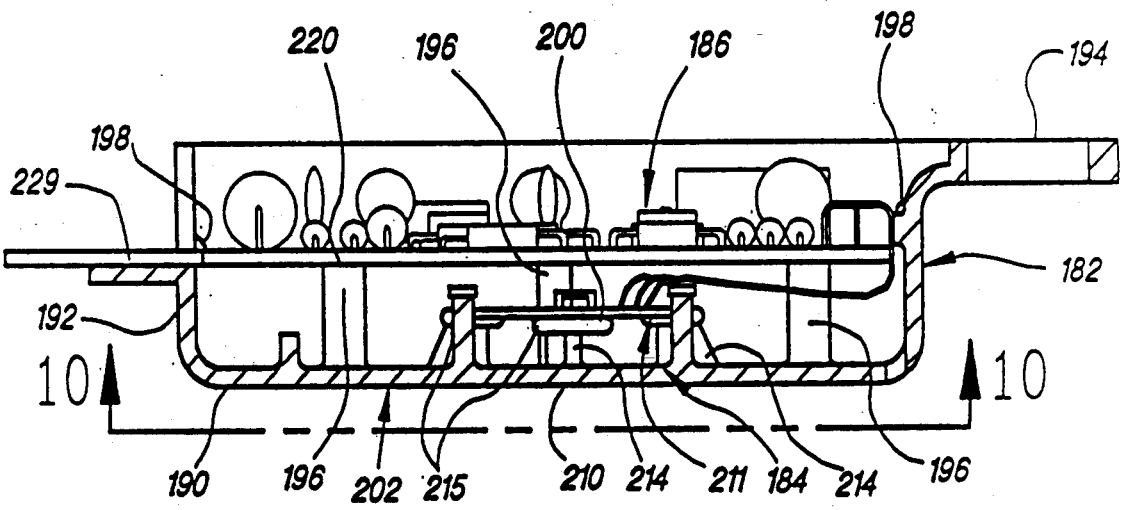
FIG. 9 is an enlarged fragmentary cross sectional view seen approximately from the plane indicated by the line 9—9 of FIG. 2.

This condition is illustrated in FIG. 8 were the gasket magnetic is at the opposite extreme of its permissible locations from that illustrated in FIG. 7 and the magnetic field F is at the opposite extreme of its band B of possible locations. In this "worst case" scenario the magnetic attractive force exceeds the force of the spring 134 opposing movement of the contact 130 and the spring deflects to engage the contact with the contractor 122.

The contacts 128, 130 and the springs 132, 134 are relatively narrow strips of the blade material which , together, form a serpentine configuration (FIG. 5) ending in a relatively wide central rectangular hub 136. The hub is magnetic and acted upon by the magnetic field particularly when the gasket magnet position is centered along the extent of the hub. When the hub 136 is attracted by the magnet it tends to cause both contacts 128, 130 to engage their respective contractors 120, 122. The serpentine shape of the blade and the resilient cantilever deflection characteristics of the springs 132, 134 produce a wiping action when the contracts and contractors engage and disengage.

When the doors 18, 20 are both fully closed the switch unit completes a circuit through healed wires 96, 98 so that the alarm signalling unit is disabled. If either door is not fully closed it s associated contact pad structure is not effectively actuated and the circuit through the led wires is interrupted. The alarm signalling unit 72 becomes active. In the preferred embodiment if either door remains open for a period of three minutes the alarm signalling unit produces a series of loud alarm tones.

Figure 10:
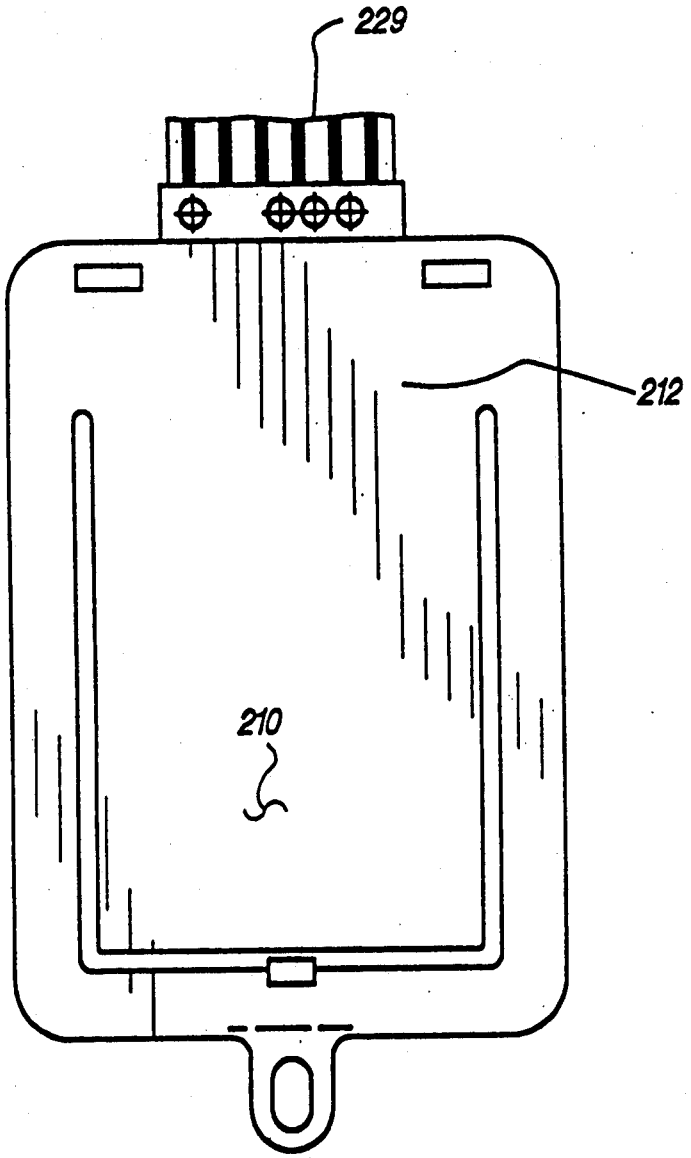
FIG. 10 is a view seen approximately from the plane indicated by the line 10—10 of FIG. 9; and, FIG. 11 is a schematic diagram of an alarm driver circuit forming part o the alarm system o the present invention.
Figure 11:
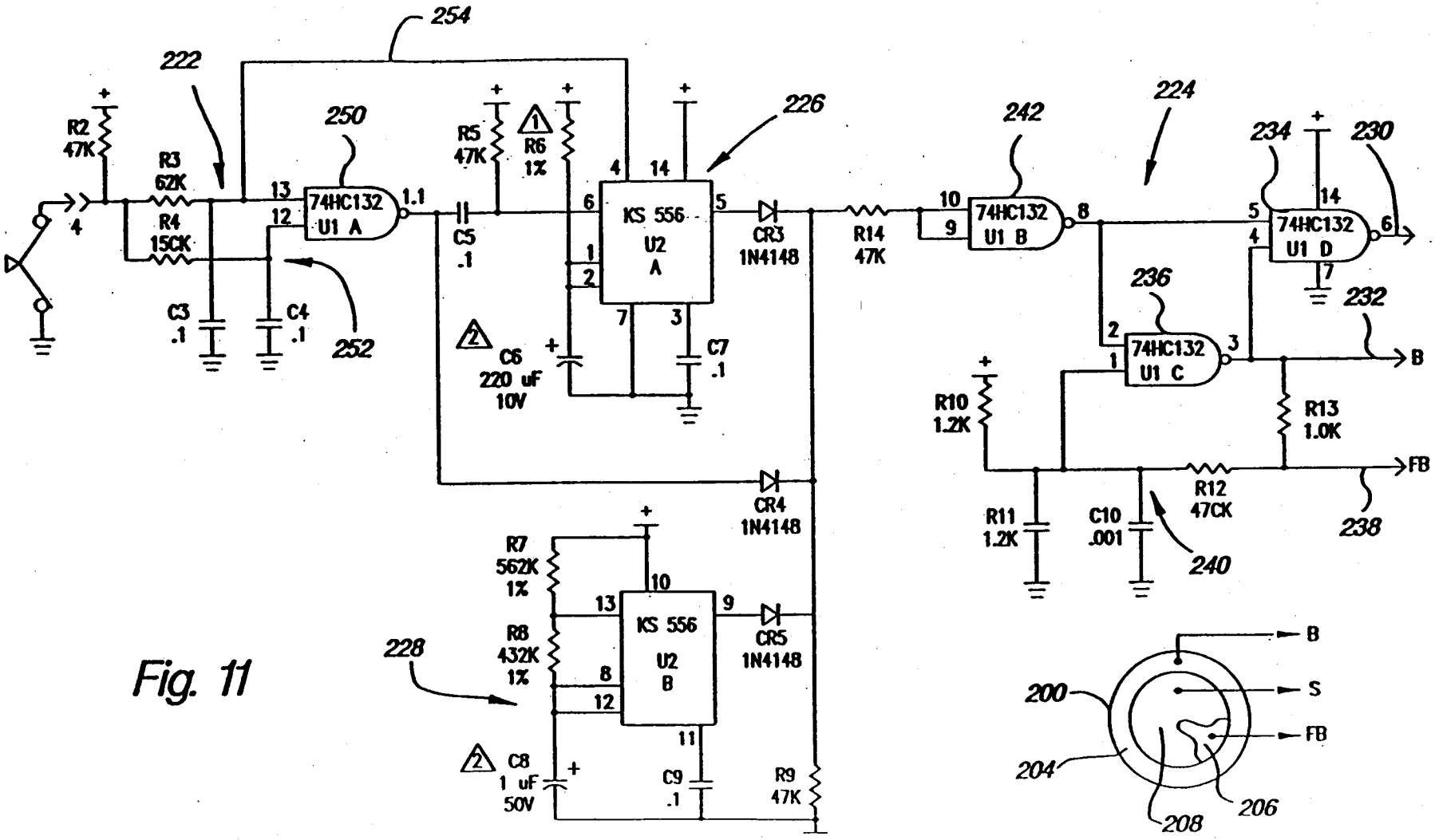

The alarm signalling unit 27 is supported at the rear of the cabinet (see FIG. 2) and comprises a housing 182 connected to the cabinet, an alarm assembly 184 (FIGS. 9–11), and an alarm assembly diving circuit 186 supported in the housing.

The housing 182 is illustrated as a molded plastic rectangular cup-like member having a housing base wall structure 190 from which a peripheral wall 192 extends to an open side of the housing. The peripheral wall 192 carries an integral mountaintop 194 projecting from one side. A mounting screw (not shown) extends through the tang to secure the housing to the cabinet with its open side flush with and closed by the cabinet. The driving circuit 186 is fixed in the housing by ribs 196 and tabs 198 which are molded into the wall 192. The plastic material is preferably polypropylene.

The alarm assembly 184 comprises an alarm member 200, in the form of a piezo electric disc (FIGS. 9 and 11) and a resonant housing wall panel 202 supporting the disc 200. The panel and disc vibrate as a unit as a predetermined operating frequency to produce an audible alarm tone.

The piezo electric disc is of conventional construction comprising a harass substrata 204 (FIG. 11) forming a common electrode and having piezo electric material deposited on one side. The piezo material is applied in two separate electrode areas to define a feedback electrode section 206 and an energizing electrode section 208, as is common practice (see FIG. 11). The subtract 204 and the crystal areas are provided with electrical leads indicated by the reference characters B, FB, and S, respectively, which are connected to the driver circuitry. The preferred disc 200 is known as a 20 mm piezo disc with feedback lead and is available from Piezo Electric Products, Inc. of Metuchen, N.J., among others.

The resonant housing wall panel 202 is formed integrally with the housing base wall structure 190 and carries the piezo disc 200 units interior side. The panel 202 comprises a genrally rectangular tongue-like cantilevered base wall section 210 and mounting structure 211 for connecting the alarm member disc 200 to the housing wall section. The section 210 is continuous with and connected to the housing base wall by a bridge structure 212 of the housing material. The cantilever section 210 is capable of vibrating relative to the housing base wall in response to vibrations of the disc 200. The bring 212 flexes to enable the vibrations.

The mounting structure 211 comprise disc supporting pedestals 214 disposed about h center of the wall section 210 and a disc mount element 215 associated with each pedestal for resiliently supporting the disc on the pedestal. The pedestals 214 are integral with the wall section, project into the housing, and define a seating ledge near the projecting pedestal end. The projecting pedestal ends are preferably of rectangular cross sectional shape.

The mount elements are formed by silicone rings resiliently supported about each pedestal and engaged with the seating ledge. The disc is seated on the rings and each pedestal end is twisted through 45 degrees about the longitudinal pedestal axis. The twisted pedestal ends are permanently deformed and, when twisted, are cut by the disc edges and ten clamp the disc and bin against the ledge as twisting continues. The rings can be O-rings, but are preferably flat, pad-like elements with a central pedestal end receiving opening. This is an important mounting procedure in that it assures the fabrication of uniformly operating alarm signalling units.

It has been found that the volume of the sound produced by the alarm is critically dependant upon the relative dimensions f the disc, the wall section 210, the disc to wall section distance and the disc operating frequency. In the preferred alarm system, for example, the disc operating frequency is about 2000 Hertz and the disc has a diameter of 20 mm. For this disc size and frequency it has been found that the wall section width should be twice the disc diameter, the wall section length should be three times the disc diameter and the distance between the disc and the wall section should be one fourth of the disc diameter.

Theses specific dimensional relationships are critical to the efficient generation of the alarm tone in the preferred embodiment. If an alarm unit si constructed using a different size piezo disc and/or a different operating frequency the dimensional values of relationships might be different, although the general relationships noted will remain critical to efficient sound production.

The alarm member driving circuit 1286 activates the alarm assembly 184 to produce a series of alarm tones in response to the switch of the sensor unit 28 remaining open for a predetermined time. The driving circuit 186 comprises a conventional circuit board 220 supported in the housing 182 near the wall section 210, a sensor switch condition responsive circuit 222 (FIG. 11), an output oscillator circuit 224 for energizing he piezo disc 200, timer circuits 226, 228 governing operation of the piezo disc by the oscillator 224, a power supply circuit (not shown), and a separator low voltage transformer (not shown).

The circuit board 220 is slipped into hehousing seats on the housing ribs 196 and is clamped in place by the tabs 198. A board terminal oplug 229 projects from the housing for connecting the board to related circuitry. The circuit components are mounted on the board so they project away from the panel 202. The flat side of the circuit board confronting the panel 202 acts as a sounding board within hehousing and can serve to enhance the volume of the alarm tone. The interaction between the sound reflected to the wall section by the board 220 and the wall section vibrations is critical and markedly enhanced when board is mounted a distance of one half the disc diameter from the walls action. This dimensional relationship value is dependant upon the specific operating frequency and the disc size; abut the general relationship is critical regardless of the particular frequency and disc size.

The low voltage transformer steps down the a.c. voltage supplied to the unit 10 to about 8 volts a.c. The power supply circuit cornets the transformer output to regulated d.c. which is supplied to the circuit 186.

The output oscillator circuit 224 is enabled to energize the piezo disc to vibrate at an operating frequency of about 2000 hertz and, when disabled, applies a constant, null voltage across the disc. The oscillator 224 comprises output leads 230, 232 connected to the disc electrodes 208, 204, respectively, NAND gates 234, 236 supplying power to the leads, a feedback lead 238 connecting the feedback electrode 206 to feedback circuitry 240 associated with the input of the NAND agate 236, and an oscillator controller NAND gate 242 or enablign and disabling the oscillator 224.

The input pins 9, 10 of the oscillator controller gate are connected to the timers 226, 228 and to the sensing circuit 222 so that when the input pins 9, 10 are high the output pin 8 is low and the oscillator is disabled. When the input pins 9, 10 are low the controller output pin is high and the oscillator is enabled.

When the oscillator 224 is disabled the NAND gates 234, 236 both produce a high output level and a null voltage across the disc electrodes. In this condition the output pin of the NAND gate 242 is low and the input pins 2, 5 of the gates 236, 234, respectively, are low. When the gate input pins 2, 5 are both low the gate outputs are both high.

When the controller gate output is high the oscillator is enabled. In this condition the input pins 5, 2 of the gates 234, 236 are high . The input pin 1 of the gate 236 is also high so the gate output pin 3 is low. This causes the output of the gate 234 to go high resulting a voltage being applied across the disc electrodes 204, 208.

The feedback circuit 240 connected to the input pin o the gate 236 contains R-C elements (C10, R12, R13) which cause the voltage at the pin 1 to decay so the gate output pin 3 goes high again resulting in the output of the gate 234 going low. This causes application of a voltage differential across the disc electrodes 204, 208.

When a voltage differential is applied across the disc electrodes 204, 208, the feedback electrode transmits a feedback voltage signal to the circuit 240. The feedback voltage signal is phase shifted by the R-C components and applied to the input pin 1 to alter the time the pin voltage exceeds the threshold of the gate 234 The result is that the oscillator output drives the disc at a resonant frequency of about 2000 Hertz whenever the oscillator is enabled.

As noted previously, the oscillator controller 24 is governed by the timers 226, 228 an the sensing circuit 222. Whenever any output of either timer of the circuit 222 is high the oscillator is disabled. When he outputs of both timers 226, 228 and the circuit 222 are all low the oscillator is enabled nd the altamonte is produced. The oscillator controller input pins are connected to the timers 226, 228 and the circuit 222 via a circuit called a "wire"0 Or gate. The OR gate comprises respective rectifier diodes CR3, CR4, and CR5 having their cathodes connected to the controller input pins 9, 10. The rectifier anode electrodes are connected to the timer 226, the circuit 222, and the timer 228, respectively. Thus when all the outputs of the timers and circuit 222 are low the controler input pins are low and the oscillator is enabled. If any one of the outputs is high the oscillator is disabled.

The circuit 222 responds to the condition of the switch unit 82 by producing an output signal for disabling the oscillator so long as the cabinet doors 18, 20 are both fully closed and the switch 82 is closed. If either door opens, the switch 82 opens. The circuit 222 responds by activating the timer 226 and conditioning the rectifier CR4 to enable the oscillator. The circuitry 222 comprises a NAND gate 250 having input thresholds for turning on and turning off, input R-C delay circuitry 252 for briefly retarding operation of the gate 250 when the switch 82 initially opens, and a reset line 254 for the timer 226.

when the switch unit 82 is closed the input pins 12, 13 of the gate 250 are connected to circuit ground through the closed switch contacts. The gate output pin 11 is high in these circumstances, forward biasing the reciter CR4, and disabling the oscillator. The delay circuitry 252 comprises parallel R-C delay circuits (R3, C3 and R4, C4, respectively) connected to the respective input pins of the gate 250. So long as the switch contacts are closed the capacitors C3, C4 are discharged through them.

When the switch contacts initially open, the capacitors change at slightly different rates until the input pins 12, 13 reach the gate threshold level. The gate then changes state with the output pin 11 going low. The brief delay prior to the output pin going low permits the timer 226 to be reset via the reset line 254 and reset pin 4. The timer 226 is a standard 555 timer.

The low gate output signal conditions the rectifier CR4 to enable the oscillator and also operates the timer 226. The low gate output signal is coupled to he timer trigger pin 6 through a capacitor C5 and appears there as a negative going pulse when the gate output goes low. The negative pulse causes the timer output pin 5 to go high. It also conditions the discharge pin 1 to discharge the timing capacitor C6 to about zero volts after which the capacitor C6 begins recharging via the resistor R6. The resistor R6 and capacitor C6 are sized so that about three minutes time is required for the capacitor to recharge to the timer threshold voltage. Application of the threshold voltage to he threshold pin 2 2 causes the timer output pin 5 to go low. This conditions the rectifier CR3 to enable the oscillator.

The timer 228 is essentially a 555 timer connected as a pulse generator which runs continuously and governs the on and off intervals of the alarm tone. In the preferred embodiment the tone sounds for a period of 0.7 seconds every second. The output pin 9 is thus low for 0.7 seconds and high for 0.3 second intervals. The low output intervals condition the rectifier CR5 to enable the oscillator and when the timer 226 and the circuit 220 are likewise conditioned to enable the oscillator the alarm tone sounds.

In the preferred alarm system the timers 226, 228 are provided by a 556 dual timer chip so that timers re both 555 timers. The NAND gates are also al formed on a common chip.

While a single preferred embodiment of the invention has been illustrated and described in detail the invention is not to be construed as limited to the precise construction disclosed. Various adaptations, modifications and uses of the invention may occur to those skilled int the art to which the invention relates. For example, the resonant will section 210 might be configured in a general rectangular shape, connected to the housing base wall by a plurality of narrow bridges extending outwardly firesides. The intention is to cover all such adaptations, modifications and uses within the scope or spirit of the appended claims.

Having described my invention I claim:

1. An alarm system for signalling when a door of a refrigerator or freezer compartment is not fully closed comprising:

a. an alarm condition sensing means for detecting whether the door is in a fully closed position, said sensing means having a first condition when the door is fully closed and a second condition when the door is away from the fully closed position;

b. an alarm signalling means for produce an alarm signal when said sensing means is in said second condition, said signalling means comprising:

i. a housing comprising an integral housing wall section joined to the housing by bridge structure which is flexible for enabling said housing wall section to move relative to the housing;

ii. a vibratable alarm member;

iii. mounting structure for connecting said alarm member to said hosing wall section so that the housing wall section id driven by said member and vibrates relative to the housing when said member vibrates at an operating frequency; and, iv. alarm member driving circuit means for effecting vibration of said alarm member at said frequency in response to said sensing means being maintained in said second condition for a predetermined time.

2. The alarm system claimed in claim 1 wherein said bridge structure flexes along a signal axis with said housing wall section projecting from said axis.

3. The alarm system claimed in claim 1 wherein said housing wall section is supported cantilever fashion by said bridge structure and has a genrally rectangular shape.

4. The alarm system claimed in claim 3 wherein said alarm member is a disc-like element, the width and length of said wall section having dimensional extends determined by and dependant upon the diameter of the disc element and the operating frequency, said width and length dimensions co acting so that said vibrating cantilever wall section resonates when said disc-like element vibrates at said operating frequency.

5. The alarm system claimed in claim 1 wherein said circuit means further comprises a supporting circuit board, said circuit board fixed in said housing a predetermined distance away from said wall section, said circuit board coacting with said wall section to form a sounding board for reflecting sound toward said wall section and enhancing the volume of the alarm tone.

6. The alarm system claimed in claim 1 wherein said alarm member mounting structure supports said alarm member a predetermine distance away from said wall section, said distance determined as a function of the alarm member size and the operating frequency so that said wall section is resonant when said alarm member vibrates at said operating frequency.

7. The alarm system claimed in claim 1 wherein said alarm member driving circuit comprises an output circuit for driving said alarm member at its operating frequency and a timer or controlling said output circuit to intermittently operate said alarm member, said system producing a series of audible alarm tones.

* * * * *

UNITED STATES PATENT AND TRADEMARK OFFICE

CERTIFICATE OF CORRECTION

PATENT NO. : 5,070,319

DATED : December 3, 1991

INVENTOR(S) : Rodney W. Scuka

It is certified that error appears in the above-identified patent and that said Letters Patent is hereby corrected as shown below:

Col. 1, line 6, delete "1".

Col. 1, line 12, delete "2".

Col. 4, line 52, delete "indicted" and insert --indicated--.

Col. 4, line 56, delete "pane" and insert --plane--.

Col. 4, line 62, delete "indicted" and insert --indicated--.

Col. 5, line 41, delete "34" and insert --44--.

Col. 5, line 49, delete "h shelfing" and insert -- the shelving--.

Col. 5, line 57, delete "has" and insert --as--.

Col. 5, line 59, delete "4" and insert --44--.

Col. 5. line 64, delete "is" (first occurrence) and insert --it--.

Col. 6, line 2, delete "e" and insert --be--.

Col. 6, line 6, delete "denies" and insert --defines--.

Col. 6, line 7, delete "coding" and insert --covering--.

Col. 6, line 13, delete "f" and insert --of--.

Col. 6, line 27, delete "attracted" and insert --attractive--.

Col. 6, line 29, delete "magnetic" and insert --magnet--.

Col. 6, line 30, delete "h" and insert --the--.

Col. 6, line 41, delete "thee" and insert --there--.

Col. 6, line 41, delete "permissible" and insert --permissibly--.

UNITED STATES PATENT AND TRADEMARK OFFICE

CERTIFICATE OF CORRECTION

PATENT NO. : 5,070,319

DATED : December 3, 1991

INVENTOR(S) : Rodney W. Scuka

It is certified that error appears in the above—identified patent and that said Letters Patent is hereby corrected as shown below:

Col. 6, line 48, delete "f" and insert --of--.

Col. 6, line 64, delete "e" and insert --be--.

Col. 6, line 64, delete "an d" and insert --and--.

Col. 7, line 6, delete "3" and insert --30--.

Col. 7, line 6, delete "156" and insert --16--.

Col. 7, line 9, delete "an" and insert --and--.

Col. 7, line 18, delete "is" and insert --in--.

Col. 7, line 19, delete "gsket" and insert --gasket--.

Col. 7, line 26, delete "b" and insert --be--.

Col. 7, line 29, delete "pat" and insert --part--.

Col. 7, line 33, delete "908" and insert --98--.

Col. 7, line 37, delete "of arcade" and insert --facade--.

Col. 7, line 38, delete "segued" and insert --glued--.

Col. 7, line 42, delete "projection" and insert --projections--.

Col. 7, line 49, delete "baked" and insert --backed--.

Col. 7, line 49, delete "thelike" and insert --the like--.

Col. 7, line 56, delete "indical" and insert --identical--.

UNITED STATES PATENT AND TRADEMARK OFFICE

CERTIFICATE OF CORRECTION

PATENT NO. : 5,070,319

DATED : December 3, 1991

INVENTOR(S) : Rodney W. Scuka

It is certified that error appears in the above—identified patent and that said Letters Patent is hereby corrected as shown below:

Col. 7, line 58, delete "(Figs. 6-6)" and insert --(Figs. 6-8)--.

Col. 7, line 58, delete "int e" and insert -- in the--.

Col. 7, line 64, delete "sampling" and insert --stamping--.

Col. 7, line 68, delete "extend" and insert -extent--.

Col. 8, line 6, delete "mold" and insert --molded--.

Col. 8, line 8, delete "ultrasonicaly" and insert --ultrasonically--

Col. 8, line 18, delete "h".

Col. 8, line 31, delete "elongaed" and insert --engaged--.

Col. 8, line 34, delete "coasts" and insert --coacts--.

Col. 8, line 50, delete "140" and insert --104--.

Col, 8, lines 50 and 51, delete "ultrasonicaly" and insert --ultrasonically--.

Col. 9, line 2, delete "magnetic" and insert --magnet--.

Col. 9, line 10, delete "ehbody" and insert -- the body--.

Col. 9, line 14, delete "once" and insert --force--.

Col. 9, line 17, delete "contactor 20" and insert --contactor 120--.

Col. 9, line 22, delete "thespring" and insert -- the spring--.

UNITED STATES PATENT AND TRADEMARK OFFICE

CERTIFICATE OF CORRECTION

PATENT NO. : 5,070,319

DATED : December 3, 1991

INVENTOR(S) : Rodney W. Scuka

It is certified that error appears in the above—identified patent and that said Letters Patent is hereby corrected as shown below:

Col. 9, line 23, delete "advice" and insert --adjacent--.

Col. 9, line 24, delete "eh" and insert --the--.

Col. 9, line 27, delete "the conactor" and insert --the contactor --

Col. 9, line 29, delete "were" and insert -- where --.

Col. 9, line 30, delete "magnetic" and insert --magnet--.

Col. 9, line 52, delete "healed" and insert --the lead--.

Col. 9, line 54, delete "it s" and insert --its--.

Col. 9, line 56, delete "led" and insert --lead--.

Col. 10, line 2, delete "mountaintop" and insert -- mounting tang--

Col. 10, line 16, delete "harass" and insert --brass--.

Col. 10, line 16, delete"substrata" and insert --substrate--.

Col. 10, line 22, delete "substract" and insert --substrate--.

Col. 10, line 31, delete "units" and insert -- on its--.

Col 10, line 32, delete "genrally" and insert --generally--.

Col. 10, line 42, delete "h" and insert --the--.

Col. 10, line 55, delete "bin" and insert --ring--.

Col. 10, line 63, delete "f" and insert --of--.

UNITED STATES PATENT AND TRADEMARK OFFICE

CERTIFICATE OF CORRECTION

PATENT NO. : 5,070,319

DATED : December 3, 1991

INVENTOR(S) : Rodney W. Scuka

It is certified that error appears in the above—identified patent and that said Letters Patent is hereby corrected as shown below:

Col. 11, line 7, delete "si" and insert --is--.

Col. 11, line 12, delete "1286" and insert --186--.

Col. 11, line 14, delete "28" and insert --82--.

Col. 11, line 24, delete "hehousing" and insert -- the housing--.

Col. 11, line 36, delete "walls action" and insert --wall section--

Col. 11, line 38, delete "abut" and insert --but--.

Col. 11, line 43, delete "cornets" and insert --converts--.

Col. 11, line 53, delete "agate" and insert --gate--.

Col. 11, line 54, delete "or" and insert --for--.

Col. 11, line 55, delete "enablign" and insert --enabling--.

Col. 12, line 7, delete "o" and insert --of--.

Col. 12, line 18, after "234" insert--.--.

Col. 12, line 22, delete "24" and insert --242--.

Col. 12, line 23, delete "an" and insert --and--.

Col. 12, line 24, delete "of" (second occurrence) and insert --or--.

Col. 12, line 25, delete "he" and insert --the--.

UNITED STATES PATENT AND TRADEMARK OFFICE

CERTIFICATE OF CORRECTION

PATENT NO. : 5,070,319

DATED : December 3, 1991

INVENTOR(S) : Rodney W. Scuka

It is certified that error appears in the above-identified patent and that said Letters Patent is hereby corrected as shown below:

Col. 12, line 27, delete "nd" and Insert --and--.

Col. 12, line 27, delete "altamonte" and insert --alarm tone--.

Col. 12, line 29, after "and" insert --to--.

Col. 12, line 31, delete "0".

Col. 12, line 31, delete "Or" and insert --OR--.

Col. 12, line 55, delete "reciter" and insert --rectifier--.

Col. 13, line 3, delete "he" and insert --the--.

Col. 13, line 14, delete second "2".

Col. 13, line 29, delete "re" and insert --are--.

Col. 13, line 30, delete "al" and insert --all--.

Col. 13, line 37, delete "int" and insert --in--.

Col. 13, line 39, delete "will" and insert --wall--.

Col. 13, line 42, delete "firesides" and insert --from the sides--.

Col. 14, line 1, delete "produce" and insert --producing--.

Claim 1, Col. 14, line 11, delete "id" and insert --is--.

UNITED STATES PATENT AND TRADEMARK OFFICE

CERTIFICATE OF CORRECTION

PATENT NO. : 5,070,319

DATED : December 3, 1991

INVENTOR(S) : Rodney W. Scuka

It is certified that error appears in the above-identified patent and that said Letters Patent is hereby corrected as shown below:

Claim 3, Col. 14, line 24, delete "genrally" and insert --generally--.

Claim 4, Col. 14, line 28, delete "extends" and insert --extents--.

Claim 4, Col. 14, line 31, delete " co acting" and insert --coacting--.

Claim 6, Col. 14, line 43, delete "predetermine" and insert --predetermined--.

Signed and Sealed this

Twenty-first Day of September, 1993

Bruce Lehman

*Attest:*

BRUCE LEHMAN

*Attesting Officer*

*Commissioner of Patents and Trademarks*